United States Patent [19]

Andersson

[11] Patent Number: 4,762,157

[45] Date of Patent: Aug. 9, 1988

[54] METHOD AND MACHINE FOR RESAWING AND WORKING BOARDS OF OPTIONAL WIDTH INTO LATHS

[75] Inventor: Bengt Andersson, Halmstad, Sweden

[73] Assignee: Waco Jonsereds AB, Halmstad, Sweden

[21] Appl. No.: 61,802

[22] Filed: Jun. 15, 1987

[30] Foreign Application Priority Data

Jun. 18, 1986 [SE] Sweden ..... 8602713

[51] Int. Cl.[4] ..... B27L 7/00

[52] U.S. Cl. ..... 144/369; 144/3 R; 144/39; 144/378; 144/253 R

[58] Field of Search ..... 144/1 R, 3 R, 39, 243, 144/244, 250 R, 250 A, 369, 373, 374, 378

[56] References Cited

U.S. PATENT DOCUMENTS 1,634,789 7/1927 Melby ..... 144/243

FOREIGN PATENT DOCUMENTS 672993 10/1963 Canada ..... 144/39

277750 9/1951 Switzerland ..... 144/39

*Primary Examiner*—W. Donald Bray

*Attorney, Agent, or Firm*—Bacon & Thomas

[57] ABSTRACT

To produce wooden laths, boards of optional width are resawn in unplaned condition, whereupon the laths are fed each into one compartment which is defined by splitting knives and within which the laths are subjected to a pressure which is directed against the feed table carrying the laths and under the action of which first the lower side and then the upper side are planed. The machine for resawing the boards and planing the laths has a feed table with a guide edge and sawing means comprising coaxially mounted saw blades adjacent the infeed end of the machine, splitting knives mounted directly after the sawing means and defining compartments each adapted to accommodate a lath, and pressure means above each compartment for applying to the laths a pressure directed against the feed table. Planing means are arranged for working, under the action of said pressure, first the lower side and then the upper side of each lath.

4 Claims, 3 Drawing Sheets

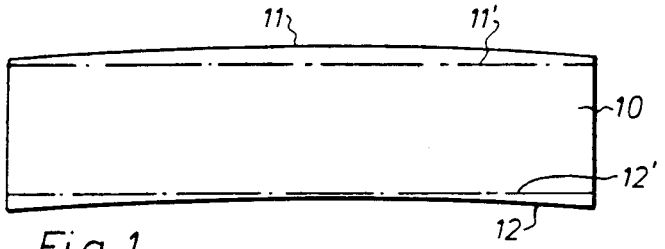
Fig. 1
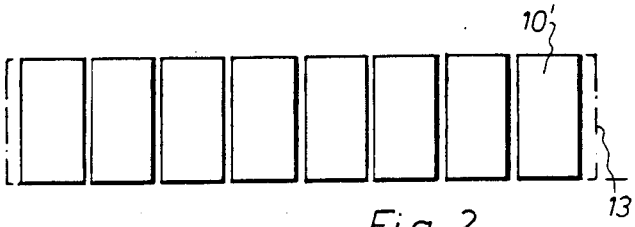
Fig. 2
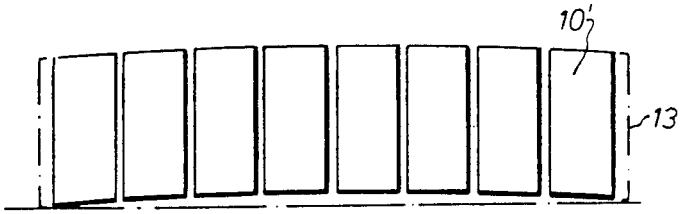
Fig. 3
Fig. 4
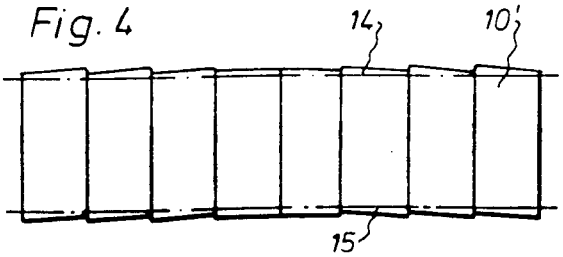

METHOD AND MACHINE FOR RESAWING AND WORKING BOARDS OF OPTIONAL WIDTH INTO LATHS

The present invention relates to a method of resawing and working boards of optional width into laths.

To produce wooden laths intended to be glued together to form laminates for the manufacture of, for example, interior fittings and furniture components, boards are first planed and then resawn into laths having the desired width. As a result of their drying, the boards from which such laths are sawn, are always slightly curved in the transverse direction, for which reason a relatively large amount of wood must be removed from the opposed flat sides of the board to make them parallel. In this manner, a fairly large amount of wood goes to waste, but this has so far been deemed unavoidable. Another difficulty in the context is that the boards must be sorted in respect of their width so that only boards of a width adapted to the saw dimensions are fed into the machine. Naturally, both the planing and the sorting of the boards makes the final product more expensive.

It is the object of this invention to reduce the waste resulting from the planing operation and to facilitate resawing of boards of optional width. This object is achieved in that the unplaned board is fed into a resawing and planing machine with one of its flat sides facing the feed table of the machine and is resawn into a number of laths of predetermined width; that the laths are introduced each into one compartment defined by rigidly clamped splitting knives which can absorb lateral forces and extend forwardly in the feed direction at least into a position for working the board flat side facing the feed table; that each lath is subjected in its compartment to a pressure directed against the feed table; that first the lath side facing the feed table and then the lath side facing away from the feed table are planed under the action of the said pressure; and that the laths then are worked by further tools or are discharged from the machine.

The machine for carrying the above-mentioned method into effect comprises a frame having a feed table and a guide edge extending along one long side of said feed table, and at least one feed mechanism adapted to feed the boards along the feed table with one flat side facing the table, as well as sawing and planing means. The machine is characterised in that the sawing means which comprises a number of saw blades adapted to the maximum board width and coaxially mounted on a drive shaft at spaced apart intervals corresponding to the desired lath width, is mounted transversely of the feed table adjacent the board infeed end; that splitting knives are rigidly mounted in the board feed direction directly after the sawing means and define between themselves compartments each adapted to accommodate a lath; that pressure means are provided above each compartment to apply to said laths a predetermined force directed against the feed table; and that first and second planing means are adapted to plane first the lower side and then the upper side of the laths.

The invention will be described in more detail below, reference being had to the accompanying drawings in which FIGS. 1 and 2 show a board as seen from one end before and after, respectively, it has been resawn into laths according to the method of the present invention;

FIGS. 3 and 4 show a board after it has been resawn into laths according to the method of the present invention;

FIG. 1 illustrates a board 10 which after drying is slightly curved in the transverse direction. If it is intended to produce laths from such a board by conventional technique, the opposed flat sides 11, 12 of the board are first planed to a depth illustrated by the dash-dot lines 11', 12'. It will be appreciated that a fairly large amount of wood goes to waste. Before the board is resawn into laths 10', the board edges are trimmed, as shown at 13. To avoid wasting wood when the flat sides are being planed, the present invention proposes resawing the board in unplaned condition, as shown in FIG. 3, whereupon the resulting laths 10' are planed. In this manner, the planing depth can be reduced, as indicated at 14 and 15 in FIG. 4. However, this planing operation requires the laths 10' to be guided in the vertical direction, and to this end the laths are introduced into compartments defined by rigidly fixed splitting knives, as will be explained below.

Figure 5:
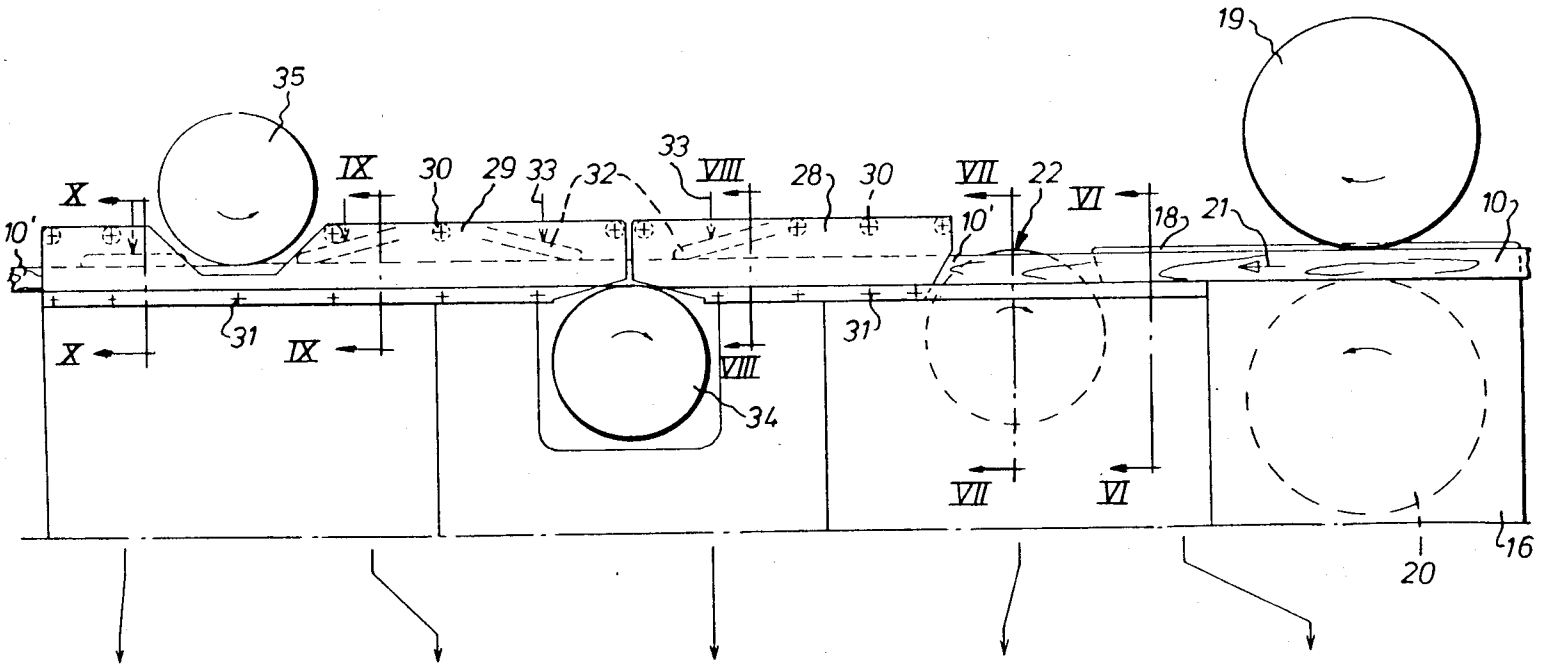
FIG. 5 is a lateral and schematic view of a machine acording to the invention for the production of laths.

FIG. 5 illustrates schematically a lath producing machine according to the invention. The machine has a frame 16 and a feed table 17 with a guide edge 18, 26 on the upper side of the frame. Boards 10 are conveyed on the feed table 17 from the right to the left in FIG. 5, as indicated by the arrow 21. To feed the boards, a conventional feed mechanism 19, 20 is provided. Mounted after the feed mechanism 19, 20 is a saw 22 comprising a driven shaft 26 which is rotatably mounted in the transverse direction of the machine and on which saw blades 24, 25 are coaxially and nonrotatably fixed. For reasons explained below, the outermost saw blade 25, i.e. the one nearest the guide edge 18, 26, is thicker than the other blades 24. A number of splitting knives 36 are rigidly fixed directly after the saw 22. The splitting knives 36 are mounted each opposite a saw blade 24, while the guide edge portion 26 is mounted opposite the thicker saw blade 25, as will appear from FIG. 7. The splitting knives 36 and the outermost splitting knife 36 and the guide edge portion 26 define a number of compartments 37 into which the laths 10' sawn by the saw 22 are fed. The splitting knives 36 must be very rigidly clamped and are therefore fixed in grooves in the feed table and in transverse holders equidistantly spaced apart along the blade length. The holders comprise spacer means 30 between the splitting knives 36 and clamping screws extending through said spacer means and the splitting knives. Other types of holders may, of course, also be used for maintaining the rigidity of the knives 36. As has been schematically indicated in FIG. 5, pressure means 32 are arranged at regular intervals within each of the compartments 37 defining the knives 36. These pressure means are adapted to apply to the laths 10' a force 33 directed against the feed table. Mounted in the frame 16, after the saw 22, is a lower cutter 34 which extends in conventional manner with part of its periphery up through an opening in the feed table for planing the lower side of the laths 10'. After the lower cutter 34, as seen in the direction of lath feed, an upper cutter 35 is mounted, also in conventional manner, for planing the upper lath side. The upper cutter 35 is mounted near the discharge end of the machine, as will appear from FIG. 5.

Figure 10:
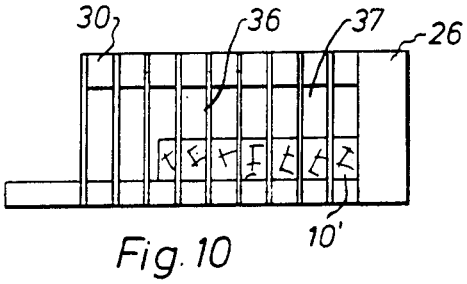
FIGS. 6–10 are cross-sectional views along lines VI—VI, VII—VII, VIII—VIII, IX—IX and X—X, respectively, in FIG. 5.
Figure 9:
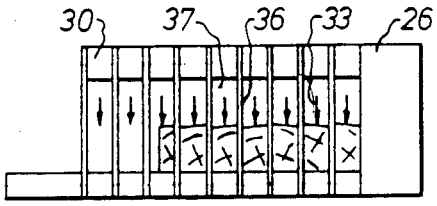
Figure 8:
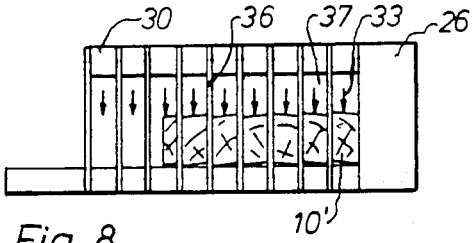
Figure 7:
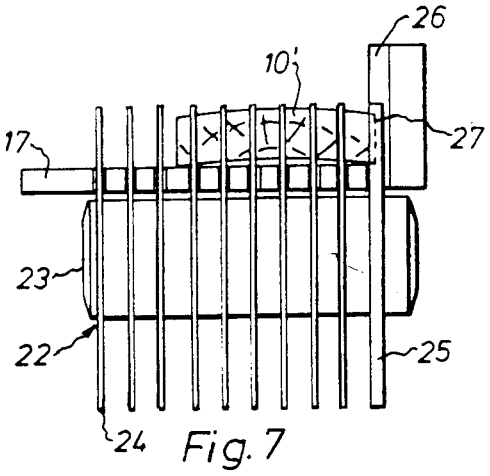
Figure 6:
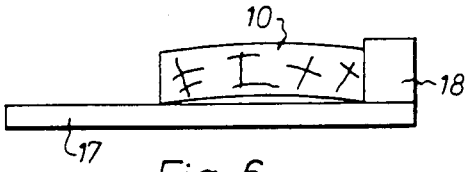

The lath-producing machine is operated in the following manner. A board 10 is fed into the machine by means of the feed mechanism 19, 20 and conveyed on the feed table 17 with one edge side in contact with the guide edge portion 18 which, in order to ensure that any unevenness at this edge is removed, lies at a greater distance from the opposite side of the feed table than the guide edge portion 26. In this manner, when the board 10 is conveyed along the guide edge portion 18 toward the saw 22, the edge side facing the guide edge 18 will be worked by the thicker saw blade 25, as indicated in FIG. 7, the inner side of which is aligned with the inner side of the subsequent guide edge portion 26, whereby the edge side is cut clean, as indicated at 27. The saw blades 24, 25 are spaced apart a distance which corresponds to the desired lath width, as are the subsequent splitting knives 36, such that the laths 10' produced by the saw 22 are directly fed each into one compartment 37, as shown in FIG. 8. Usually, the lath farthest away from the guide edge portion 26 will be insufficiently wide, but this is not important because this lath is fed together with the remaining laths and therefore eventually leaves the machine in the form of waste. Since the board has been resawn in unplaned condition, the upper and lower sides of the laths 10' have a slight slant, as shown in FIG. 8, resulting from the original cup of the board. This slant is removed by planing, and to this end the laths are subjected to the action of the pressure means 32 exerting the downward directed force 33. As a result, the laths are pressed against the feed table and conveyed in this condition to the lower cutter 34 which planes the lower side so that the laths will have the appearance shown in FIG. 9, with right angles between the lower side and the edge sides. The rigidity of the splitting knives eliminates any risk that the laths may tilt in the compartments. The laths 10' are then moved on under the action of said pressure force 33 to be worked by the upper cutter 35. The laths 10' now have the appearance shown in FIG. 10 and are discharged from the machine.

The machine described above has been developed to enable resawing and planing also of wood which is of inferior quality (large knot areas), and therefore the splitting knives extend beyond the upper cutter. If the quality of the wood is higher, the knives merely need to extend slightly beyond the upper cutter. The machine illustrated in the drawings merely carries out sawing and planing, but other working means, such as sanding means, may of course be mounted after the cutters.

Because the board is first resawn and then planed, far less wood will go to waste, as has been mentioned above, and this is of course a considerable advantage from the economic point of view. As will appear from the above description, boards of optional width can be fed into the machine and resawn and planed without difficulty. A sufficient number of saw blades 24 and splitting knives 36 should be arranged to enable the machine to work boards of maximum width.

If it is desired to produce broader or narrower laths, both the saw 22 and the splitting knife arrangement must be replaced, and to this end these components preferably are in the form of readily exchanged cassettes. In FIG. 5, the splitting knives are divided into two groups carried each by one cassette 28 and 29 connected to the machine frame by means of bolts 31. The cassettes form with their lower side part of the feed table, or may extend through recesses therein provided for this purpose.

What I claim and desire to secure by Letters Patent is:

1. A machine for resawing boards of optional width into laths, comprising a frame having a feed table and a guide edge extending along one long side of said feed table, at least one feed mechanism adapted to feed the boards along the feed table with one flat side facing the table, as well as planing and sawing means, wherein said sawing means comprise a number of saw blades adapted to the maximum board width and coaxially mounted on a drive shaft at spaced apart intervals corresponding to the desired lath width and being mounted transversely of the feed table adjacent the board infeed end; splitting knives rigidly mounted in the board feed direction directly after the sawing means and defining between themselves compartments each adapted to accommodate a lath; pressure means provided above each compartment to apply to said laths a predetermined force directed against the feed table; and first and second planing means adapted to plane first the lower side and then the upper side of the laths.

2. A machine as claimed in claim 1, wherein said sawing means and the splitting knives with the pressure means are arranged in the form of exchangeable cassettes to enable the lath width to be varied.

3. A machine as claimed in claim 1, wherein said splitting knives are rigidly clamped by means of grooves in the feed table and a plurality of transverse holders.

4. A method of resawing and working boards of optional width into laths comprising the steps of:

(a) feeding an unplaned board into a resawing and planing machine with one flat side of the board facing a feed table of the machine;

(b) sawing the board into a plurality of laths of predetermined width;

(c) introducing each lath into a compartment defined by rigidly clamped splitting knives for absorbing lateral forces and extending forwardly in the feed direction at least into a position for working the flat side of the board facing the feed table;

(d) subjecting each lath in its compartment to a pressure directed against the feed table for first planing the side of the lath facing the feed table and thereafter planing the side of the lath facing away from the feed table; and (f) discharging the laths from the machine.

* * * * *